US011037583B2

(12) United States Patent
Suzuki et al.

(10) Patent No.: US 11,037,583 B2
(45) Date of Patent: Jun. 15, 2021

(54) DETECTION OF MUSIC SEGMENT IN AUDIO SIGNAL

(71) Applicant: INTERNATIONAL BUSINESS MACHINES CORPORATION, Armonk, NY (US)

(72) Inventors: Masayuki Suzuki, Tokyo (JP); Takashi Fukuda, Kanagawa-ken (JP); Toru Nagano, Tokyo (JP)

(73) Assignee: International Business Machines Corporation, Armonk, NY (US)

( * ) Notice: Subject to any disclaimer, the term of this patent is extended or adjusted under 35 U.S.C. 154(b) by 135 days.

(21) Appl. No.: 16/116,042

(22) Filed: Aug. 29, 2018

(65) Prior Publication Data

US 2020/0075042 A1 Mar. 5, 2020

(51) Int. Cl.
*G10L 25/81* (2013.01)
*G10L 25/21* (2013.01)

(52) U.S. Cl.
CPC ..... *G10L 25/81* (2013.01); *G10L 25/21* (2013.01)

(58) Field of Classification Search
CPC ..... G10L 25/21
USPC ..... 704/205
See application file for complete search history.

(56) References Cited

U.S. PATENT DOCUMENTS 9,026,440 B1 5/2015 Konchitsky
9,398,150 B2 7/2016 Keller et al.
9,557,956 B2 * 1/2017 Kobayashi ..... G06F 3/165
10,296,638 B1 * 5/2019 Chen ..... G06F 16/433
2012/0155655 A1 6/2012 Parkhomenko et al.
2014/0358264 A1 * 12/2014 Long ..... H04L 43/0852 700/94
2015/0332708 A1 * 11/2015 Keller ..... H04M 3/4285 704/270

FOREIGN PATENT DOCUMENTS

CN 102956230 B * 3/2017 ..... G10L 25/78

OTHER PUBLICATIONS

Klaus Seyerlehner, Tim Pohle, Markus Schedl, Sep. 2007, Dept. of Computational Perception, Johannes Kepler University Linz, Austria Automatic Music Detection in Television Productions, Proc. of the 10th Int. Conference on Digital Audio Effects (DAFx-07), Bordeaux, France, Sep. 10-15, 2007 (Year: 2007).*

P. Bellini, I. Bruno and P. Nesi, "Optical music sheet segmentation," Proceedings First International Conference on WEB Delivering of Music. WEDELMUSIC 2001, Florence, Italy, 2001, pp. 183-190, doi: 10.1109/WDM.2001.99017 (Year: 2001).*

(Continued)

*Primary Examiner* — Bharatkumar S Shah
(74) *Attorney, Agent, or Firm* — Tutuniian & Bitetto. P.C.; Randall Bluestone

(57) ABSTRACT

A technique for detecting a music segment in an audio signal is disclosed. A time window is set for each section in an audio signal. A maximum and a statistic of the audio signal within the time window are calculated. A density index is computed for the section using the maximum and the statistic. The density index is a measure of the statistic relative to the maximum. The section is estimated as a music segment based, at least in part, on a condition with respect to the density index.

20 Claims, 9 Drawing Sheets

(56) References Cited

OTHER PUBLICATIONS

P. Bellini, I. Bruno and P. Nesi, "Optical music sheet segmentation," Proceedings First International Conference on WEB Delivering of Music. WEDELMUSIC 2001, Florence, Italy, 2001, pp. 183-190, doi: 10.1109/WDM.2001.990175. (Year: 2001).*

P. Bellini, I. Bruno and P. Nesi, "Optical music sheet segmentation," Proceedings First International Conference on WEB Delivering of Music. WEDELMUSIC 2001, Florence, Italy, 2001, pp. 183-190, doi: 10.1109/WDM.2001.99017 (Year: 2001) (Year: 2001).*

O. Gillet, S. Essid and G. Richard, "On the Correlation of Automatic Audio and Visual Segmentations of Music Videos," in IEEE Transactions on Circuits and Systems for Video Technology, vol. 17, No. 3, pp. 347-355, Mar. 2007, doi: 10.1109/TCSVT.2007.890831. (Year: 2007).*

* cited by examiner

250

```
# parameters
TH_DENSE = 0.10 # A
TH_MAX = 0.2 # B
TH_MIN = 0.01 # C
TH_CONT0 =10 # D
TH_CONT1 =10 # E
```
250a

```
# read input
Read speech signal
Apply time window
```
250b

```
# estimator
for each window:
  Calculate max in the window
  Calculate mean in the window
  Calculate mean/max as "density"
  if TH_DENSE < dense and TH_MIN < max < TH_MAX
    estimate the region as music-on-hold
else
    estimate the region as non-music-on-hold
```
250c

```
# smoother
change results into music-on-hold if a segment is smaller than
TH_CONT0 and sandwiched by music-on-hold regions
change results into non-music-on-hold if a segment is smaller than
TH_CONT1 and sandwiched by non-music-on-hold regions
```
250d

```
output results
```
250e

FIG. 6

DETECTION OF MUSIC SEGMENT IN AUDIO SIGNAL

BACKGROUND

Technical Field

The present disclosure, generally, relates to acoustic segmentation techniques, more particularly, to techniques for detecting a music segment in an audio signal.

Description of the Related Art

Audio signals such as recordings of telephone conversations may include a music segment, such as a music-on-hold part. Conventionally, there is no effective technique for detecting such music segments in the audio signals, and processing according to a specific purpose (e.g., STT (Speech-To-Text) processing, training of STT models, etc.) has often been performed for the audio signal including such music segments as it is.

SUMMARY

According to an embodiment of the present invention, a computer-implemented method for detecting a music segment in an audio signal is provided. The method includes setting a time window for each section in an audio signal. The method also includes calculating a maximum and a statistic of the audio signal within the time window. The method further includes computing a density index for the section using the maximum and the statistic, in which the density index is a measure of the statistic relative to the maximum. The method includes further estimating the section as a music segment based, at least in part, on a condition with respect to the density index.

Computer systems and computer program products relating to one or more aspects of the present invention are also described and claimed herein.

Additional features and advantages are realized through the techniques of the present invention. Other embodiments and aspects of the invention are described in detail herein and are considered a part of the claimed invention.

BRIEF DESCRIPTION OF THE DRAWINGS

The subject matter, which is regarded as the invention, is particularly pointed out and distinctly claimed in the claims at the conclusion of the specification. The foregoing and other features and advantages of the invention are apparent from the following detailed description taken in conjunction with the accompanying drawings in which:

FIG. 6 depicts a pseudo-code for detecting a music segment in an audio signal according to an exemplary embodiment of the present invention;

DETAILED DESCRIPTION

Hereinafter, the present invention will be described with respect to particular embodiments, but it will be understood by those skilled in the art that the embodiments described below are mentioned only by way of examples and are not intended to limit the scope of the present invention.

One or more embodiments according to the present invention are directed to computer-implemented methods, computer systems and computer program products for detecting a music segment in an audio signal, in which a novel index (so called "density" index herein) is calculated for each section in the audio signal.

Figure 1:
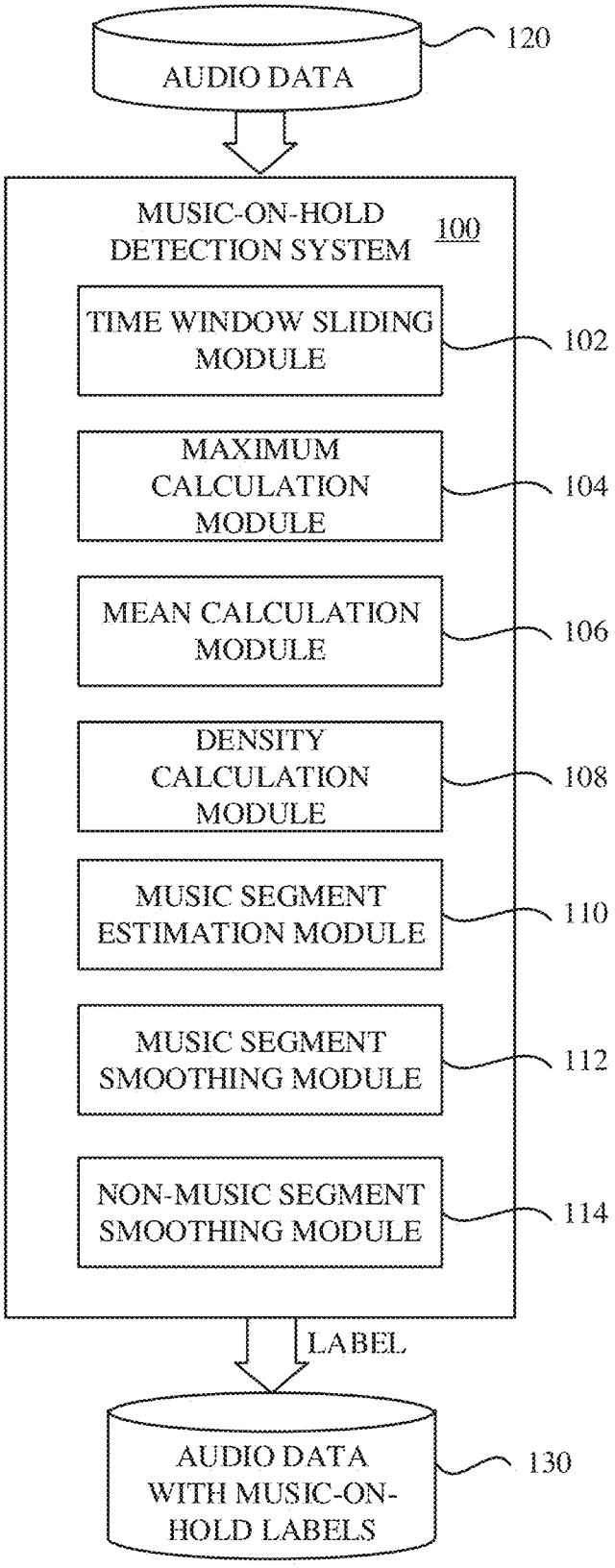
FIG. 1 illustrates a block diagram of a music-on-hold detection system according to an exemplary embodiment of the present invention.

With reference to FIG. 1, a block diagram of a music-on-hold detection system according to an exemplary embodiment of the present invention is illustrated.

As shown in FIG. 1, there is a music-on-hold detection system 100 that is configured to perform a novel process of detecting a music-on-hold part in a given audio data. The music-on-hold detection system 100 reads an audio data 120 and output a music-on-hold label, which may be stored together with the audio data 120 to give an audio data with music-on-hold labels 130. The music-on-hold label is a label aligned to a part of the audio data 120 where the music-on-hold is considered to be played.

In FIG. 1, a detail of the music-on-hold detection system 100 is shown. The music-on-hold detection system 100 includes a time window sliding module 102 that slides a time window on an audio signal; a maximum calculation module 104 that calculates a maximum of the audio signal within the time window; a mean calculation module 106 that calculates a mean of the audio signal within the time window; a density calculation module 108 that computes a novel density index based on the calculated mean and the maximum of the audio signal; and a music segment estimation module 110 that estimates a section of the audio signal as a music segment or non-music segment based, at least in part, on the computed density index.

The audio data 120 read by the music-on-hold detection system 100 may be any audio files or streams in an appropriate format that can be rendered into an audio waveform. The audio data 120 may be converted into an audio signal during preprocessing. The audio signal converted from the audio data 120 may be any one of the absolute value of the signal of the audio waveform, the energy (square) of the signal of the audio waveform and the logarithm of the energy of the signal of the audio waveform. In the described embodiment, the absolute value of the signal of the audio waveform is employed as the audio signal.

The time window sliding module 102 is configured to set a time window for each section in the audio signal by sliding the time window with a predetermined sliding interval. The whole audio signal may be partitioned into a plurality of sections, each of which has an interval corresponding to the predetermined sliding interval. The length of the sliding interval may not be limited and may be set in consideration of the balance between the calculation cost and the accuracy.

The time window may be defined by an appropriate window function, which is simply a rectangular shape function in the described embodiment. However, it is not intended to exclude that the window function includes shapes other than rectangular. The length of the time window is preferably longer than a typical length of several phonemes. The length of the time may be in the range of approximately 1 second to 20 second although not limited thereto.

The time window may be set around each section. In a particular embodiment, the length of time windows may be different from the sliding interval and thus the time windows for adjacent sections may overlap each other. In other particular embodiment, the length of time windows may be the same as the sliding interval, and thus, the time windows do not overlap each other.

The maximum calculation module 104 is configured to calculate a maximum of the audio signal within the time window, for each section. The maximum calculation module 104 detects a highest peak over the range of the time window.

The mean calculation module 106 is configured to calculate a mean of the audio signal within the time window. The mean calculation module 106 may sum up data points of the audio signal within the time window and divide the sum by the length of the time window (the number of the data points in the time window).

The density calculation module 108 is configured to compute a density index for each section using the maximum and the mean that are calculated for the corresponding section. In the described embodiment, the density index is defined as a measure of the mean relative to the maximum. In a particular embodiment, the density index is computed by dividing the mean by the maximum.

In the described embodiment, the mean of the audio signal is calculated to compute the novel density index. However, any of other statistics including a median, a mode, a variance, entropy, etc. may also be used to compute the novel density index, by treating the value of the audio signal as the observation value. Also, the way of using the maximum is not limited to dividing the statistic. The maximum can be used for some kind of normalization of the statistic. Thus, the density index may be defined as a measure of the statistic relative to the maximum.

The music segment estimation module 110 is configured to estimate each section as a music segment or a non-music segment based, at least in part, on a predetermined condition, which includes at least a condition with respect to the density index computed for the corresponding section. Note that the music segment may be a segment considered as constituting a music-on-hold part. The non-music segment is a segment considered as not constituting the music-on-hold part. The non-music segment may include a segment considered as constituting a speech part, a silence part, or other part.

The music segment estimation module 110 according to the exemplary embodiment is configured to compare the computed density index with a first threshold (A). The section determined to have the density index larger than the first threshold (A) may be estimated to be the music segment. The section determined to have the density index not larger than the first threshold (A) is estimated to be the non-music segment. The music segment estimation module 110 may label each section depending on whether the corresponding section has been estimated to be the music segment or the non-music segment. When the absolute values of the signal of the audio waveform are employed, the first threshold (A) may be in the range of approximately 0.05 to 0.20 although not limited thereto.

The predetermined condition may include not only the condition for the density index but also other conditions for other indices such as maximum, mean, and the like. In a preferable embodiment, the predetermined condition may further include conditions for the maximum. The music segment estimation module 110 may be configured to further compare the maximum of the audio signal with a second threshold (B) and/or a third threshold (C). The second threshold (B) defines an upper limit for the maximum, which may prevent clipping regions from being detected as the music segment. The third threshold (C) defines a lower limit for the maximum, which prevents silence regions (with a noise) from being detected as the music segments. The section determined to have the maximum larger than the second threshold (B) or smaller than the third threshold (C) is estimated to be non-music segment even if the predetermined condition is satisfied in terms of the density index.

When the absolute values of the signal of the audio waveform are employed, the second threshold (B) may be in the range of approximately 0.1 to 0.8 although not limited thereto. Similarly, the third threshold (C) may be in the range of approximately 0.001 to 0.05 although not limited thereto.

By performing estimation processing on each section in the audio signal, a sequence of labelled sections is obtained. In a particular embodiment, the obtained sequence of the labelled sections can be used as it is. However, there may be a small noisy fragment with a label different from that of the surrounding that is estimated as either the music segment or the non-music segment.

As shown in FIG. 1, the music-on-hold detection system 100 may further include a music segment smoothing module 112 that aggregates one or more blocks of the music segments separated by a fragment of the non-music segment to form a larger block representing music segments; and a non-music segment smoothing module 114 that aggregates one or more blocks of the non-music segments separated by a fragment of the music segment to form a larger block representing non-music segments.

The music segment smoothing module 112 is configure to find one or more non-music segments that are sandwiched between the music segments and have a length shorter than a fourth threshold (D) and change each of the found one or more non-music segments into a music segment. The fourth threshold (D) may be in the range of approximately 5 second to 20 second although not limited thereto.

The non-music segment smoothing module 114 is configure to find one or more music segments that are sandwiched between non-music segments and have a length shorter than a fifth threshold (E), and change each of the found one or more music segments into a non-music segment. The fifth threshold (E) may be in the range of approximately 5 second to 20 second although not limited thereto.

By performing the smoothing process for the segments, a sequence of labelled sections including relatively large blocks, each of which is estimated as either the music or non-music segment, is obtained. The obtained sequence of the labelled sections may be stored together with the original audio data (as the audio data with music-on-hold labels 130).

In particular embodiments, each of modules 102~114 of the music-on-hold detection system 100 described in FIG. 1 may be, but not limited to, implemented as a software module including program instructions and/or data structures in conjunction with hardware components such as a processor, a memory, etc.; as a hardware module including electronic circuitry; or as a combination thereof. These modules 102~114 described in FIG. 1 may be implemented on a single computer device such as a personal computer and a server machine or over a plurality of devices such as a computer cluster of the computer devices in a distributed manner. The audio data 120, 130 may be stored in a storage area provided by using any internal or external storage device or medium, to which a processing circuity of a computer system implementing the music-on-hold detection system 100 is operatively coupled.

Figure 2:
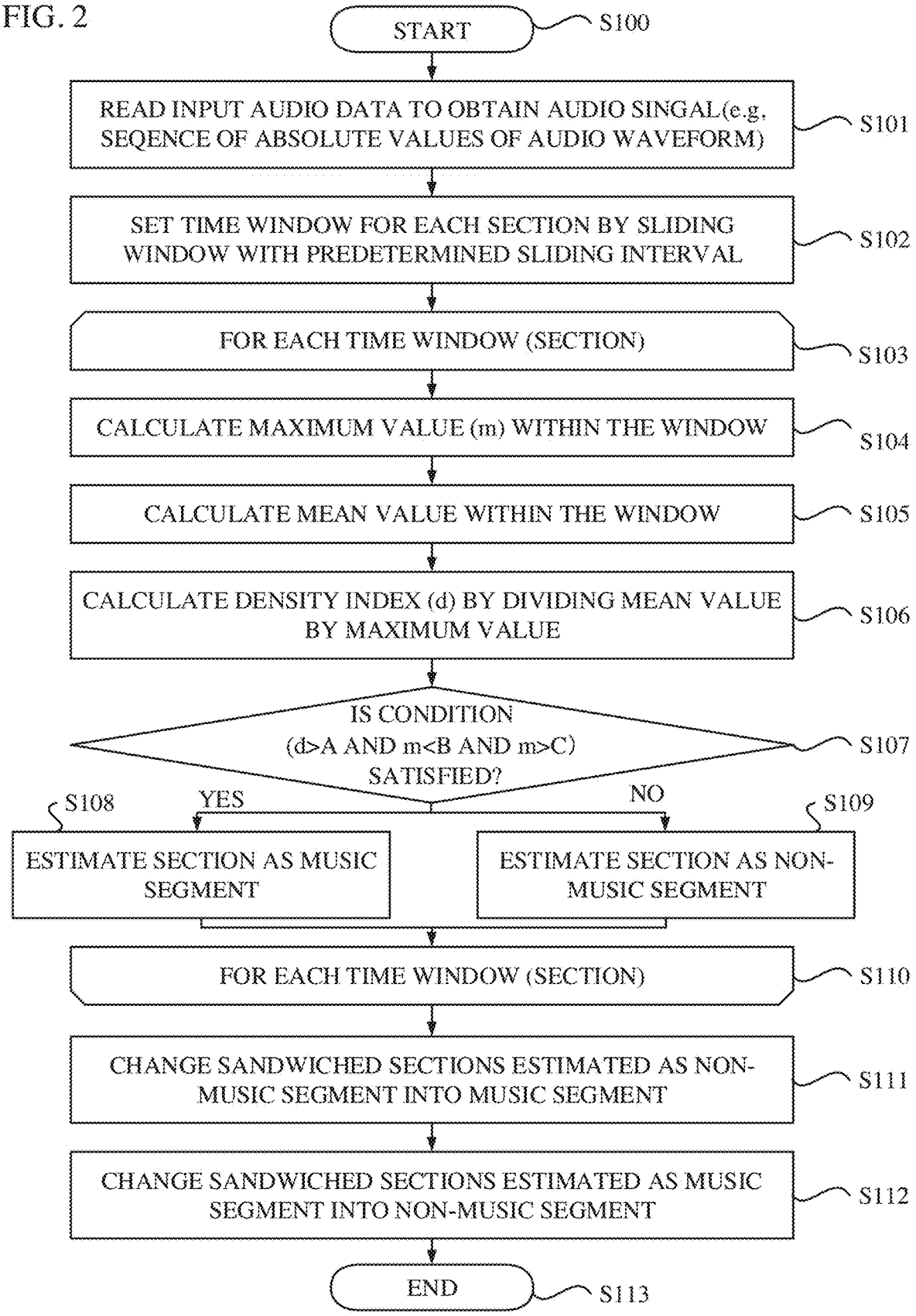
FIG. 2 is a flowchart depicting a process for detecting a music segment in an audio signal according to an exemplary embodiment of the present invention.
Figure 3:
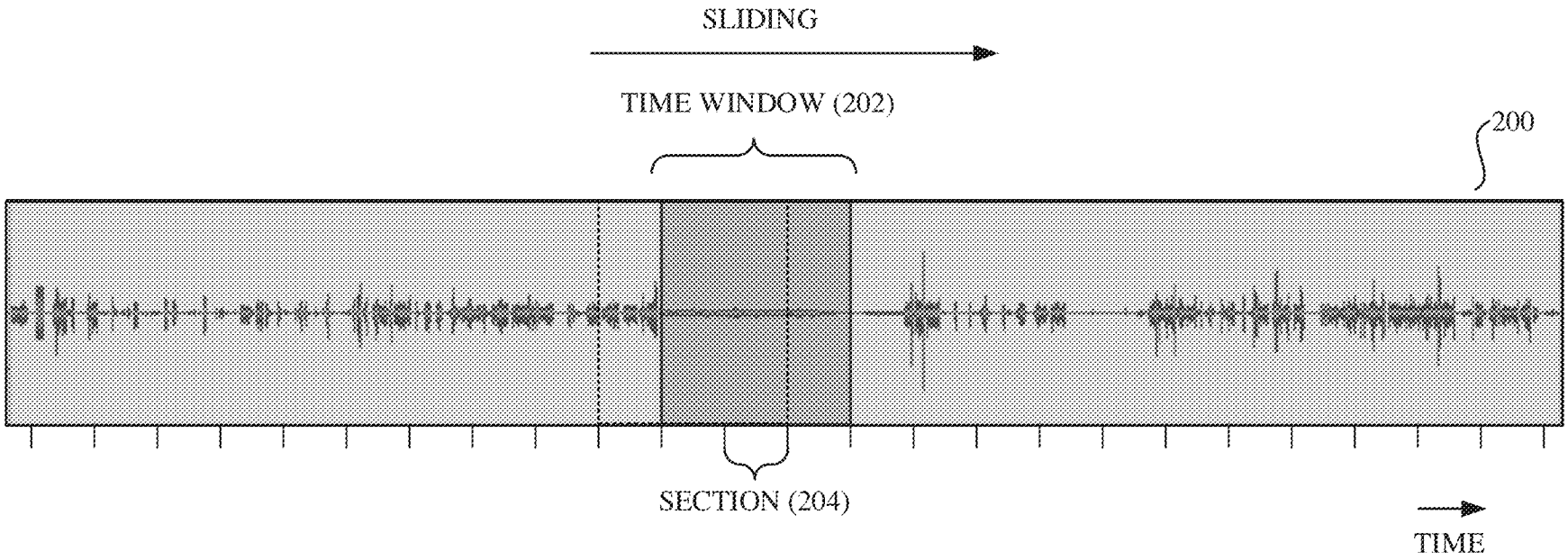
FIG. 3 describes a way of setting a time window on the audio signal according to an exemplary embodiment of the present invention.

Hereinafter, referring to FIG. 2 together with FIGS. 3-5, a process of detecting a music segment in an audio signal according to an exemplary embodiment of the present invention is described. FIG. 2 shows a flowchart of the process for detecting the music segment in the audio signal.

The process shown in FIG. 2 may begin at block S100 in response to receiving, from an operator, a request for music-on-hold detection, which may specify an input audio data to be processed. Note that the process shown in FIG. 2 may be performed by a processing circuitry such as a processing unit of a computer system that implements the music-on-hold detection system 100 shown in FIG. 1. Also note that the process shown in FIG. 2 is described to be a process for single input audio data. The process shown in FIG. 2 may be performed for each audio data in a given collection stored in the data storage.

At block S101, the processing unit may read the input audio data to obtain an audio signal. In the block S101, the processing unit may convert the input audio data into the audio signal, which may be the absolute value of the signal of the audio waveform, the energy (square) of the signal of the audio waveform or the logarithm of the energy of the signal of the audio waveform. In the described embodiment, the audio signal is represented by a sequence of the absolute value of the signal of the audio waveform that is rendered using the input audio data.

At block S102, the processing unit may set a time window for each section in the audio signal by sliding the time window with a predetermined sliding interval. FIG. 3 shows a way of setting the time window on the audio signal. As shown in FIG. 3, there is an audio signal (represented in a form of audio waveform but not a form of its absolute value in FIG. 3) 200 and the time window 202 slides on the audio signal 200 along the time axis with the predetermined interval, giving a plurality of sections 204, each of which has an interval corresponding to the predetermined sliding interval. In the described embodiment, the time window 202 has a length longer than the sliding interval and is set around each section 204.

Referring back to FIG. 2, a loop from block S103 to block S110 is performed repeatedly for each time window 202 (or each section).

At block S104, the processing unit may calculate a maximum level of the audio signal (m) within the time window. At block S105, the processing unit may calculate a mean level of the audio signal within the time window 202. In one embodiment, the mean is simply arithmetic mean. At block S106, the processing unit may compute a density index (d) for the section by dividing the mean level by the maximum level. The density index is a measure of the mean level relative to the maximum level.

Figure 4:
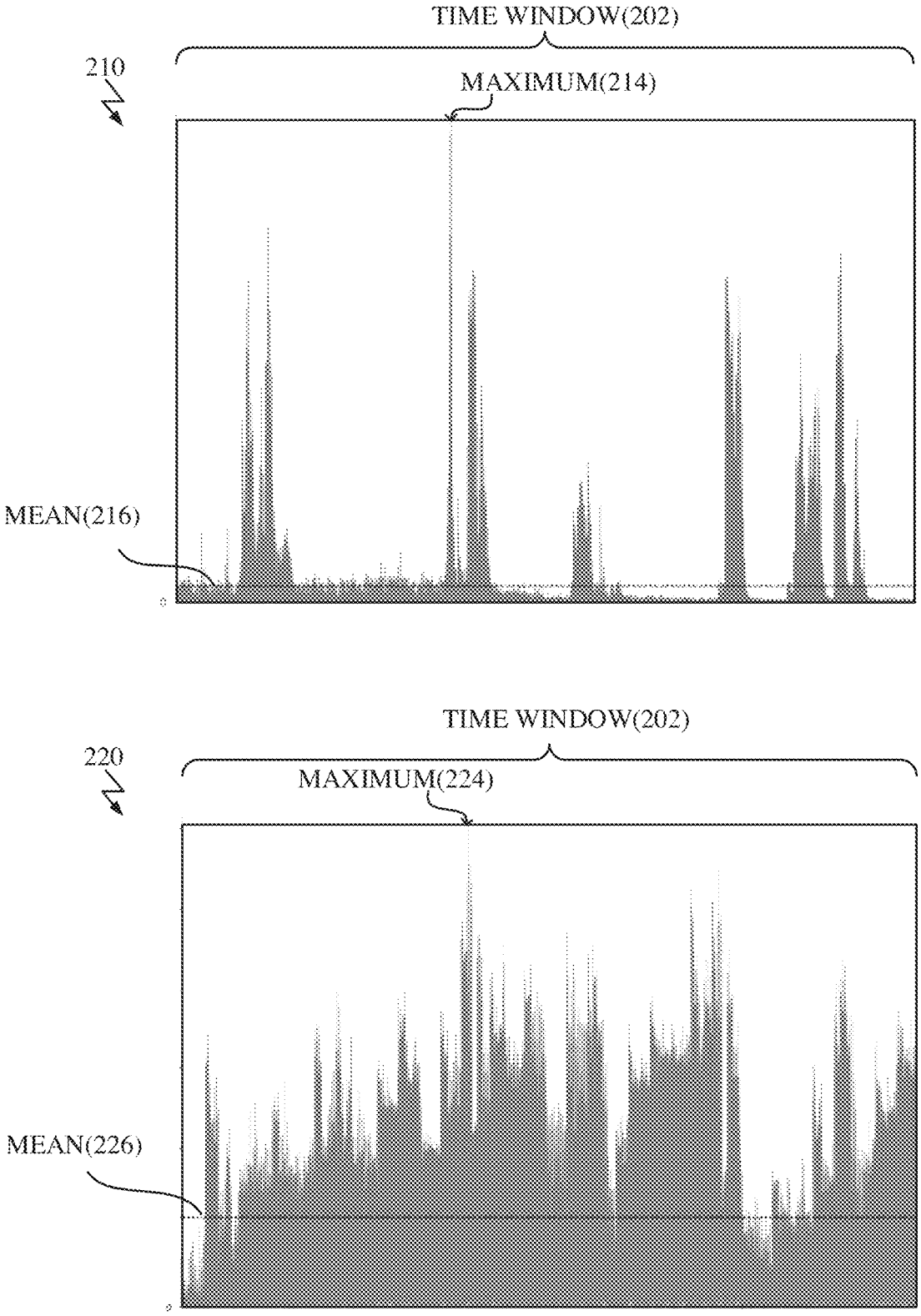
FIG. 4 depicts schematics of calculating a density index based on a maximum and a mean according to an exemplary embodiment of the present invention.

FIG. 4 depicts representations for calculating a density index based on the maximum and the mean. As shown in FIG. 4, there are two representations 210, 220 of calculating a density index based on the maximum level and the mean level. The upper representation 210 shows a case where a non-music part (e.g., speech part) is analyzed. On the other hand, the lower representation 220 shows a case where a music part (music-on-hold part) is analyzed. Note that the vertical axes of the schematics 210, 220 are rescaled by the corresponding maximum levels 214, 224, respectively. Thus, it is noted that the vertical levels between the schematics 210, 220 are not comparable each other.

As shown in FIG. 4, a part of the audio signal corresponding to the speech may be represented as a waveform where amplitude swings in response to vocalizations of vowels and consonants. Typically, the mean level 216 of the speech part is relatively low within the range defined by of the maximum level 214. The signal of the speech part is seemed to be somewhat "sparse" in a box area that has a width corresponding to the length of the time window and a height corresponding to the maximum level 214.

On the other hand, a part of the audio signal where the music-on-hold is played is represented as a waveform where amplitude swings in response to continuation of melodies. The mean level 226 of the music-on-hold part is relatively high within the range defined by of the maximum level 224. The signal of the music-on-hold part looks somewhat "dense" in a box area that has a width corresponding to the length of the time window and a height corresponding to the maximum level 224.

The recorded music, which is typically employed as the music-on-hold, has generally had techniques applied thereto to enlarge loudness (magnitude of auditory sensation of sound) without changing dynamic range, which may include automatic gain control (AGC), Dynamic Range Compression (DRC), etc. Therefore, it is expected that the music-on-hold part shows larger "density" compared to the other parts such as speech and noise parts. In the light of the distinctive difference between the recorded music and others, the novel "density" index that measures the mean level relative to the maximum level can be a good measure for distinguishing the music segments from other segments. The trend is expected to be similar even if the density index calculated from other statistic instead of using the mean level is employed.

Referring back to FIG. 2, at blocks S107-S109, the processing unit may estimate the section of the time window, as a music segment or a non-music segment based, at least in part, on a predetermined condition. The predetermined condition in the described embodiment includes a condition with respect to the density index, which includes a first threshold (A) for the density index (d), and two other conditions with respect to the maximum level, which includes a second threshold (B) and a third threshold (C) for the maximum level (m) of the audio signal. The second threshold (B) defines an upper limit for the maximum level and the third threshold (C) defines a lower limit for the maximum level.

At block S107, the processing unit may determine whether or not the predetermined condition is satisfied. In the step S107, the processing unit may compare the computed density index (d) with the first threshold (A). If the density index is larger than the first threshold (d>A), the processing unit may further compare the calculated maximum level (m) with the second threshold (B) and the third threshold (C). If the maximum level is smaller than the second threshold (m<B) and is larger than the third threshold (m>C), the processing unit may determine that the predetermined conditions is satisfied. On the other hand, if the density index is not larger than the first threshold (d=<A), the processing unit may determine that the predetermined condition is not satisfied without having to compare with the conditions for the maximum level (m). Also, if the maximum level is not smaller than the second threshold (m>=B) or is not larger than the third threshold (m=<C), the processing unit may determine that the predetermined condition is not satisfied even if the density index is larger than the first threshold (d>A).

At block S107, in response to determine that the predetermined condition is satisfied, the process may branch to block S108. At block S108, the processing unit may estimate the section as a music segment. At block S107, in response to determine that the predetermined condition is not satisfied, the process may branch to block S109. At block S109, the processing unit may estimate the section as a non-music segment.

By excluding the section having the maximum level not smaller than the second threshold (m>=B) from candidates for music segments, clipping regions are prevented from being detected as the music segment, thereby reducing errors for clipping regions. Also by excluding the section having the maximum level not larger than the third threshold (m=<C) from candidates for music segments, silence regions (typically noisy region) are prevented from being detected as the music segment, thereby reducing errors for silence regions.

When the loop from block S103 to block S110 has been completed for every section, a sequence of sections labelled as the music segment or the non-music segment is obtained and the process may proceed to block S111.

At block S111, the processing unit may try to find one or more non-music segments sandwiched between the music segments and change each of the one or more non-music segments into a music segment if the one or more non-music segments sandwiched has a length shorter than a fourth threshold (D).

At block S112, the processing unit may try to find one or more music segments sandwiched between non-music segments and change each of one or more music segments into a non-music segment if the one or more music segments has a length shorter than a fifth threshold (E).

Figure 5:
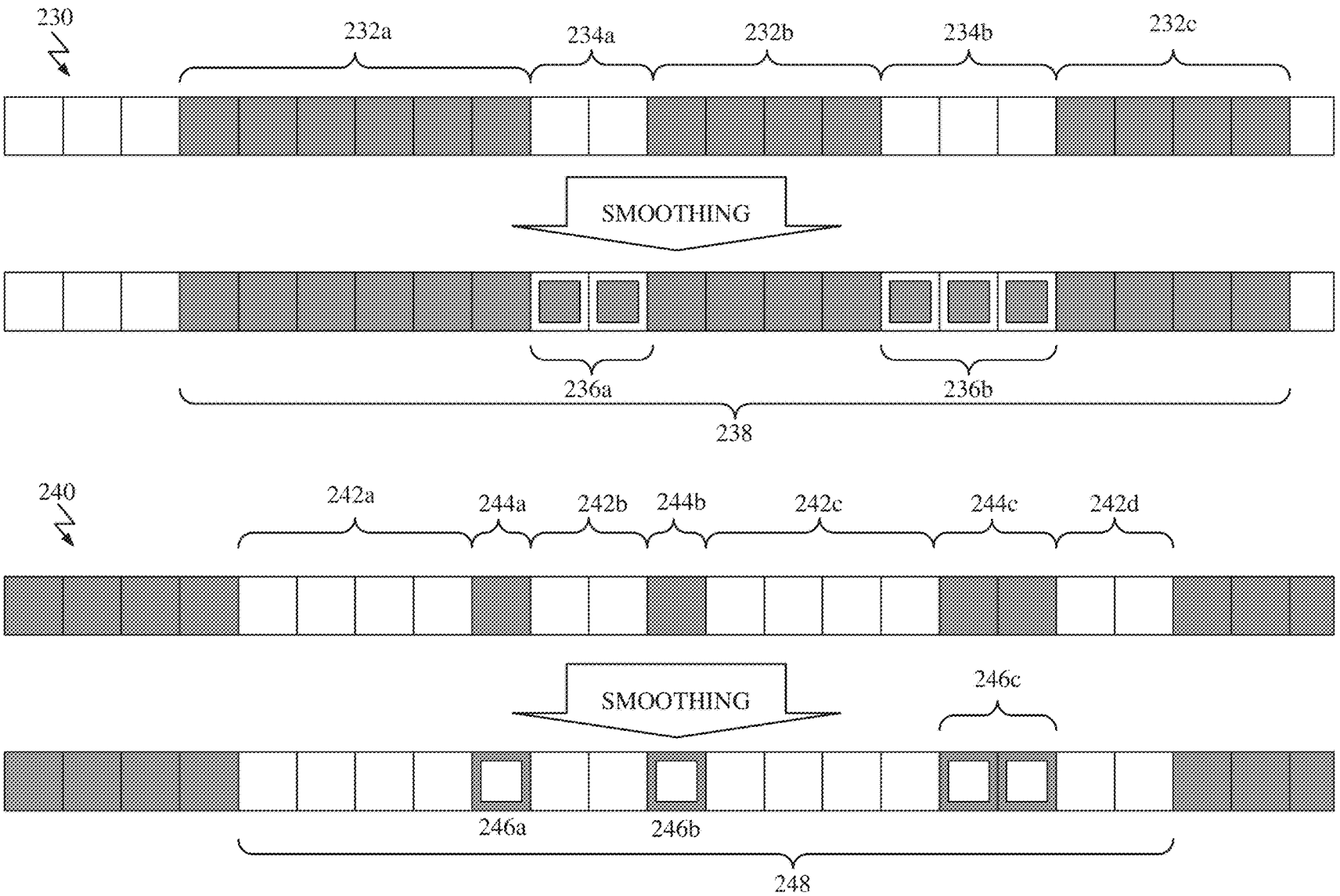
FIG. 5 depicts schematics of smoothing music segments and non-music segments according to an exemplary embodiment of the present invention.

FIG. 5 depicts representations in which music segments 230 and non-music segments 240 are smoothed. The representations 230, 240 show techniques for smoothing the music segments and the non-music segments, respectively. Note that the section estimated as the music segment is represented by a box with gray (e.g., 232*a*, 232*b*, 232*c*, 244*a*, 244*b*, 244*c*), whereas the section estimated as the non-music segment is represented by a box with white (e.g., 234*a*, 234*b*, 242*a*, 242*b*, 242*c*, 242*d*). The double box with gray inside (e.g., 236*a*, 236*b*) represents a section changed from the non-music segment into the music segment. The double box with white inside (e.g., 246*a*, 246*b*, 246*c*) represents a section changed from the music segment into the non-music segment.

As shown in the schematics 230 of FIG. 5, one or more blocks 232*a*-232*c* of the music segments separated by fragments 234*a*, 234*b* of the non-music segment are aggregated to form one larger block 238 representing the music segments. The larger block 238 may include the original music segments 232*a*-232*c* and the segments 236*a*, 236*b* flipped afterward.

As shown in the schematics 240 of FIG. 5, one or more blocks 242*a*-242*d* of the non-music segments separated by fragments 244*a*-244*c* of the music segment are aggregated to form one larger block 248 representing the non-music segments. The larger block 248 may include the original non-music segments 242*a*-242*d* and the segments 246*a*-246*c* flipped afterward.

By performing the smoothing process, a sequence of labelled sections including relatively large blocks that are estimated as either the music segments or the non-music segments is obtained. By applying smoothing, the performance of the detection could improve since music-on-hold has a certain length.

Referring back to FIG. 2, the obtained sequence of the labelled sections may be stored and the process may end at S113.

With reference to FIG. 6, a pseudo-code for detecting a music segment in an audio signal is described. In the pseudo-code 250 shown in FIG. 6, there are several parts including a parameter initialization part 250*a*; a time window setting part 250*b*; an estimation part 250*c*; a smoothing part 250*d*; and an output part 250*e*.

In the parameter initialization part 250*a*, parameters such as the thresholds (A, B, C, D, E) are initialized. In the time window setting part 250*b*, the time window is slid on the input audio data. In the estimation part 250*c*, the maximum and the mean of the audio signal are calculated and the density index is computed based on the maximum and the mean of the audio signal. Furthermore, the determination is made as to whether each section is the music segment or the non-music segment based on the computed density index. In the smoothing part 250*d*, the one or more blocks separated by a fragment having a different label are aggregated to form a larger block. In the output part 250*e*, the resultant for the given audio data is output.

Figure 7:
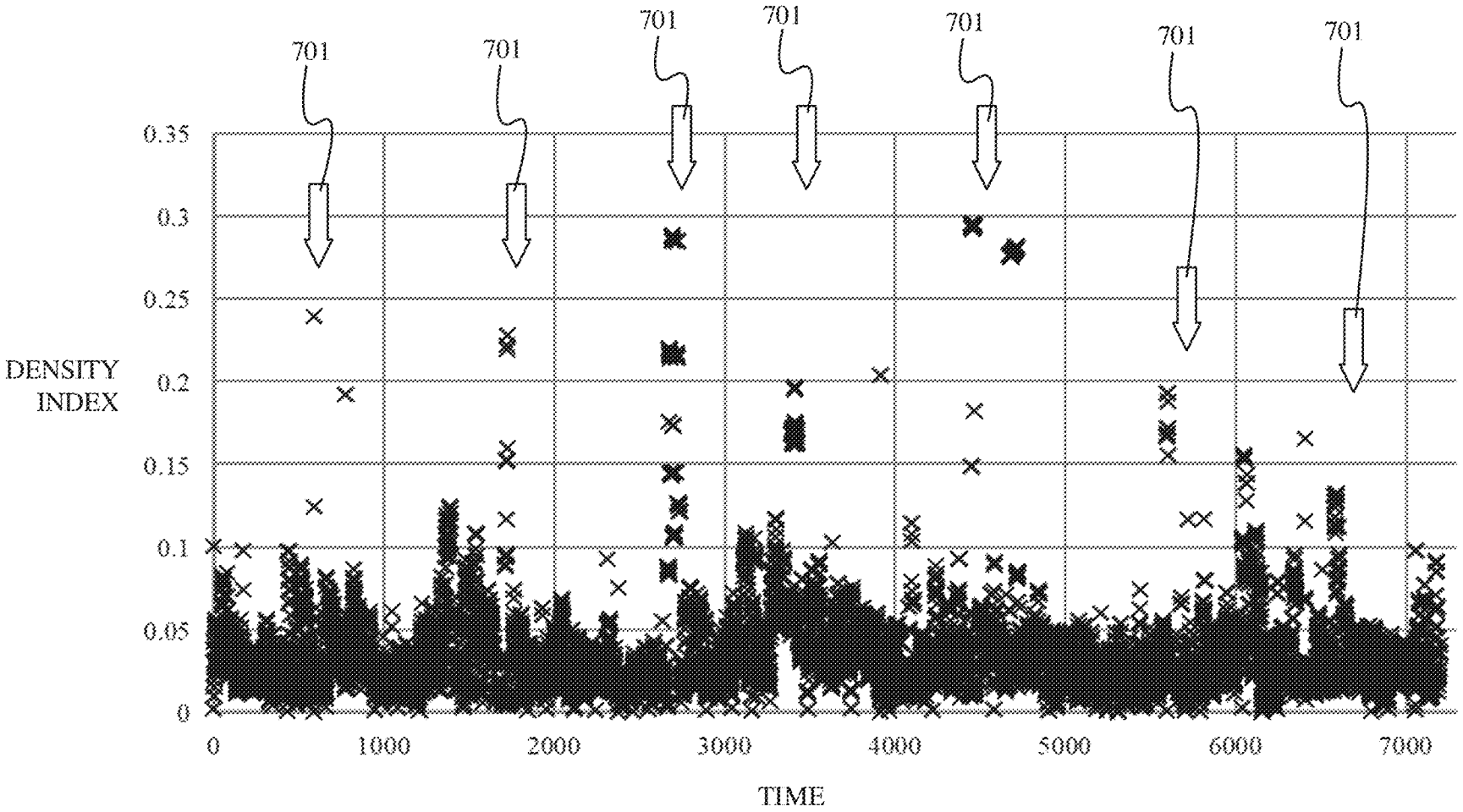
FIG. 7 describes a way of setting a first threshold (A) according to an embodiment of the present invention.

Note that the value of the thresholds (A, B, C, D, E) may be set empirically or based on a collection of samples. With reference to FIG. 7, a way of setting the first threshold (A) for the density index is described. In a particular embodiment, the first threshold (A) can be set according to a standard deviation ($\sigma$) of the values of the density index that are calculated from certain length of the audio data that includes a music part and a speech part. In a particular embodiment, $2\sigma$ of the density index can be used as the first threshold (A) for the density index. FIG. 7 shows a sequence of the values of the density index of 2 hours of speech conversation including music-on-hold. Arrows 701 point to the music-on-hold regions. In this example, the mean was calculated to be 0.038, and the standard deviation was calculated to be 0.035, and thus, $2\sigma$ was 0.108, which can be used as the first threshold (A).

Since the values of the second, third fourth and fifth thresholds (B, C, D and E) other than the first threshold (A) may also affect the performance of the detection, the ways of setting the second, third fourth and fifth thresholds (B, C, D and E) will be described below.

In a particular embodiment, the second, third fourth and fifth thresholds (B, C, D and E) can be set based on the collection of the samples. For example, the maximum is calculated for each of music-on-hold samples, the maximum of the maximums can be used as the second threshold (B) and minimum of the maximums can be used as the third threshold (C). If the number of the music-on-hold samples is considered to be insufficient, some margin can be added to the threshold (B) and subtracted from the threshold (C), respectively. Similarly, the length is measured for each of the music-on-hold samples, the maximum of the length can be used as the fourth threshold (D) and the minimum of the length can be used as the fifth threshold (E). If the number of the music on hold samples is considered to be insufficient, some margin can be added to the threshold (D) and the threshold (E), respectively.

Figure 8:
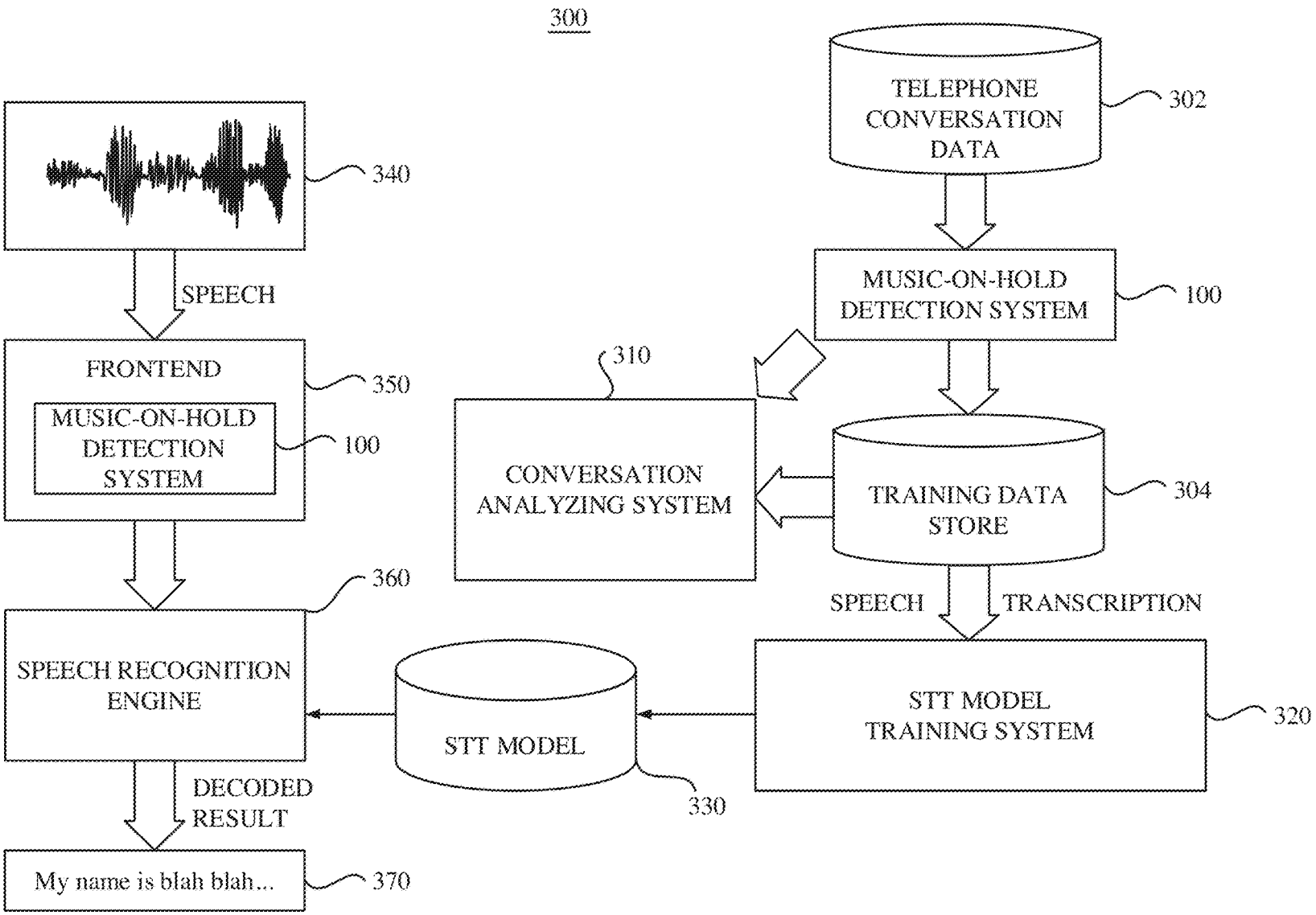
FIG. 8 illustrates use cases of the music-on-hold detection system according to an exemplary embodiment of the present invention.

Referring to FIG. 8, use cases of the music-on-hold detection system according to the exemplary embodiment of the present invention is further described.

As shown in FIG. 8, there are a conversation analyzing system 310; a STT model training system 320; and a speech recognition engine 360 as potential modules that use the result of the novel detection process according to the exemplary embodiment of the present invention.

The conversation analyzing system 310 may perform an analysis on a telephone conversation data 302. In a particular embodiment, the conversation analyzing system 310 can perform the analysis by leveraging the result of the music on hold detection system 100. For example, the length of the music-on-hold would affect customer satisfaction in call center operations. Thus, the conversation analyzing system 310 can utilize the result of the music-on-hold detection system 100 to quantify the customer satisfaction in combination with other metrics.

The STT model training system 320 may perform training process by using a given training speech data stored in the training data store 304 to build the STT model 330, which may be used by the speech recognition engine 360. In a particular embodiment, the training speech data stored in the training data store 304 includes a training sample originating from the result of the music-on-hold detection system 100. The part of the audio data estimated as the music segments are preferably excluded from the training data, in order to prevent performance degradation due to contamination of non-speech parts.

The speech recognition engine 360 may perform speech recognition based on the STT model 330, which may or may not be trained using the training data processed by the music-on-hold detection system 100. There is a frontend 350 before the speech recognition engine 104. The frontend 350 may extract acoustic features from a received speech signal 340 by any known acoustic feature analysis to generate a sequence of the extracted acoustic features. In a particular embodiment, the frontend 350 may include further the music-on-hold detection system 100 according to the exemplary embodiment of the present invention. The frontend 350 may exclude the part estimated as the music part from the target of the recognition. The speech recognition engine 360 may predict most plausible speech contents for the input speech signals 340 based on the STT model 330 to output decoded results 370 while excluding the music-on-hold part from the target.

According to the exemplary embodiments described with reference to FIGS. 1 to 5, computer-implemented methods, computer systems and computer program products for detecting a music segment in an audio signal are provided, in which a novel index (so called "density" index herein) is calculated for each section in the audio signal as a feature. The novel "density" index that measures the statistic relative to the maximum can be a good feature for distinguishing the music segments from other segments.

According to the computer-implemented methods, the computer systems and the computer program products described herein, improvements to functions and capabilities of a computer would be provided through reductions of a resource requirement (e.g., utilization of processing circuitry) and/or a storage requirement (e.g., a consumption of memory space). Such the improvements of the functions and the capabilities of the computer can be obtained by providing the computer-implemented methods, the computer systems and the computer program products for detecting a music segment in an audio signal.

It is possible to reduce the utilization of the processing circuitry and the consumption of the memory space by excluding the music segment from the target of the processing of the specific purpose (e.g., STT process, training of a STT model) in comparison with a case where the processing is performed according to the specific purpose with the music segment included. It is considered that the performance, obtained when learning a speech recognition model without identifying the music-on-hold parts first, would be degraded and the time needed for training and/or analyzing could also increase slightly.

Note that in the aforementioned embodiments, the computed density index is compared with the predetermined threshold to detect the music segment. However, the way of detecting the music segment is not limited to the specific way. In other embodiments, other feature such as a linguistic feature can also be combined with the density index with high complementarity to detect the music-on-hold more precisely since the novel density index is computed by methodology largely different from other. For example, a part of the music-on-hold may appear after typical phrases such as "Please wait a moment." By combining such linguistic feature with the novel density index, the music-on-hold can be detected more precisely in comparison with using the novel density index solely.

Experimental Studies

A program implementing the system and process shown in FIG. 1 and FIG. 2 according to the exemplary embodiment was coded and executed for a given collection of recording data of telephone conversations. A rectangular window function was employed and the length of the time window was set to be 10 seconds and the sliding interval was set to be 1 second. The first, second, third, fourth and fifth thresholds were set to be 0.1, 0.2, 0.01, 10 seconds and 10 seconds, respectively.

As for Example 1, totally 2 hours of recording of in-bound-calls of telephone conversations between agents and customers were prepared. In the 2 hours of the telephone conversations, seven music-on-hold parts were manually identified. The recording totaling 2 hours was input to the novel music-on-hold detection program. Consequently, seven parts were detected as the music segments, which was almost identical to the known positions (FIG. 7). The precision was 100% and the recall was also 100% for this smaller test.

Furthermore, as for Example 2, recordings of 50 in-bound-calls of telephone conversation between agents and customers were prepared. Average length of the telephone conversation was 5 minutes. The recordings of the 50 in-bound-calls of the telephone conversation were input to the novel music-on-hold detection program. Consequently, 13 parts in total were detected as the music segments. Among these 13 parts detected as the music segment, 12 parts were actual music-on-hold parts and 1 part was silence region. The precision was 92% and the recall was N/A (Not Available).

Computer Hardware Component

Figure 9:
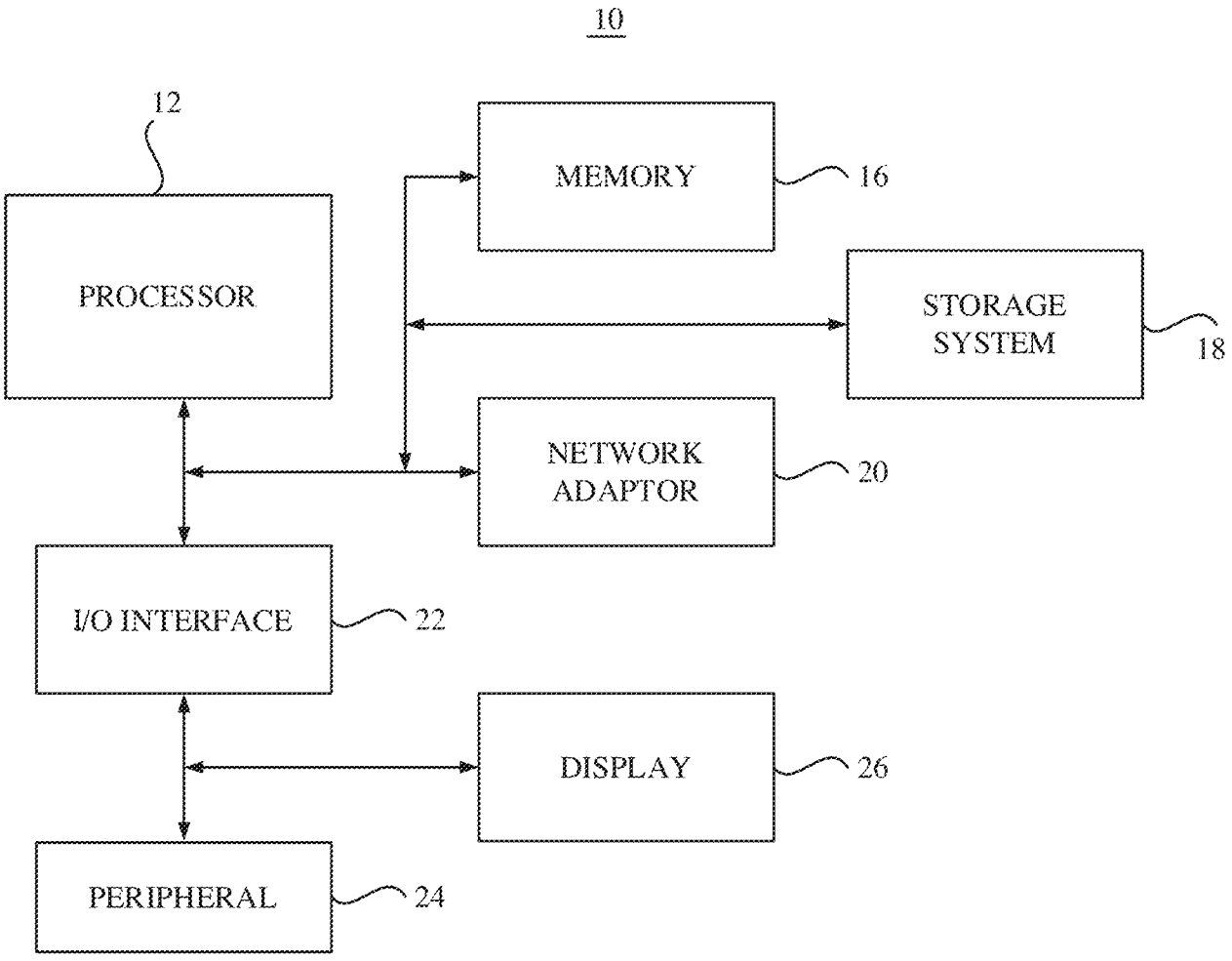
FIG. 9 depicts a schematic of a computer system according to one or more embodiments of the present invention.

Referring now to FIG. 9, a schematic of an example of a computer system 10, which can be used for the music-on-hold detection system 100, is shown. The computer system 10 shown in FIG. 9 is implemented as computer system. The computer system 10 is only one example of a suitable processing device and is not intended to suggest any limitation as to the scope of use or functionality of embodiments of the invention described herein. Regardless, the computer system 10 is capable of being implemented and/or performing any of the functionality set forth hereinabove.

The computer system 10 is operational with numerous other general purpose or special purpose computing system environments or configurations. Examples of well-known computing systems, environments, and/or configurations that may be suitable for use with the computer system 10 include, but are not limited to, personal computer systems, server computer systems, thin clients, thick clients, handheld or laptop devices, in-vehicle devices, multiprocessor systems, microprocessor-based systems, set top boxes, programmable consumer electronics, network PCs, minicomputer systems, mainframe computer systems, and distributed cloud computing environments that include any of the above systems or devices, and the like.

The computer system 10 may be described in the general context of computer system-executable instructions, such as program modules, being executed by a computer system. Generally, program modules may include routines, programs, objects, components, logic, data structures, and so on that perform particular tasks or implement particular abstract data types.

As shown in FIG. 9, the computer system 10 is shown in the form of a general-purpose computing device. The components of the computer system 10 may include, but are not limited to, a processor (or processing unit) 12 and a memory 16 coupled to the processor 12 by a bus including a memory bus or memory controller, and a processor or local bus using any of a variety of bus architectures.

The computer system 10 typically includes a variety of computer system readable media. Such media may be any available media that is accessible by the computer system 10, and it includes both volatile and non-volatile media, removable and non-removable media.

The memory 16 can include computer system readable media in the form of volatile memory, such as random access memory (RAM). The computer system 10 may further include other removable/non-removable, volatile/non-volatile computer system storage media. By way of example only, the storage system 18 can be provided for reading from and writing to a non-removable, non-volatile magnetic media. As will be further depicted and described below, the storage system 18 may include at least one program product having a set (e.g., at least one) of program modules that are configured to carry out the functions of embodiments of the invention.

Program/utility, having a set (at least one) of program modules, may be stored in the storage system 18 by way of example, and not limitation, as well as an operating system, one or more application programs, other program modules, and program data. Each of the operating system, one or more application programs, other program modules, and program data or some combination thereof, may include an implementation of a networking environment. Program modules generally carry out the functions and/or methodologies of embodiments of the invention as described herein.

The computer system 10 may also communicate with one or more peripherals 24 such as a keyboard, a pointing device, a car navigation system, an audio system, etc.; a display 26; one or more devices that enable a user to interact with the computer system 10; and/or any devices (e.g., network card, modem, etc.) that enable the computer system 10 to communicate with one or more other computing devices. Such communication can occur via Input/Output (I/O) interfaces 22. Still yet, the computer system 10 can communicate with one or more networks such as a local area network (LAN), a general wide area network (WAN), and/or a public network (e.g., the Internet) via the network adapter 20. As depicted, the network adapter 20 communicates with the other components of the computer system 10 via bus. It should be understood that although not shown, other hardware and/or software components could be used in conjunction with the computer system 10. Examples, include, but are not limited to: microcode, device drivers, redundant processing units, external disk drive arrays, RAID systems, tape drives, and data archival storage systems, etc.

Computer Program Implementation

The present invention may be a computer system, a method, and/or a computer program product. The computer program product may include a computer readable storage medium (or media) having computer readable program instructions thereon for causing a processor to carry out aspects of the present invention.

The computer readable storage medium can be a tangible device that can retain and store instructions for use by an instruction execution device. The computer readable storage medium may be, for example, but is not limited to, an electronic storage device, a magnetic storage device, an optical storage device, an electromagnetic storage device, a semiconductor storage device, or any suitable combination of the foregoing. A non-exhaustive list of more specific examples of the computer readable storage medium includes the following: a portable computer diskette, a hard disk, a random access memory (RAM), a read-only memory (ROM), an erasable programmable read-only memory (EPROM or Flash memory), a static random access memory (SRAM), a portable compact disc read-only memory (CD-ROM), a digital versatile disk (DVD), a memory stick, a floppy disk, a mechanically encoded device such as punch-cards or raised structures in a groove having instructions recorded thereon, and any suitable combination of the foregoing. A computer readable storage medium, as used herein, is not to be construed as being transitory signals per se, such as radio waves or other freely propagating electromagnetic waves, electromagnetic waves propagating through a waveguide or other transmission media (e.g., light pulses passing through a fiber-optic cable), or electrical signals transmitted through a wire.

Computer readable program instructions described herein can be downloaded to respective computing/processing devices from a computer readable storage medium or to an external computer or external storage device via a network, for example, the Internet, a local area network, a wide area network and/or a wireless network. The network may comprise copper transmission cables, optical transmission fibers, wireless transmission, routers, firewalls, switches, gateway computers and/or edge servers. A network adapter card or network interface in each computing/processing device receives computer readable program instructions from the network and forwards the computer readable program instructions for storage in a computer readable storage medium within the respective computing/processing device.

Computer readable program instructions for carrying out operations of the present invention may be assembler instructions, instruction-set-architecture (ISA) instructions, machine instructions, machine dependent instructions, microcode, firmware instructions, state-setting data, or either source code or object code written in any combination of one or more programming languages, including an object oriented programming language such as Smalltalk, C++ or the like, and conventional procedural programming languages, such as the "C" programming language or similar programming languages. The computer readable program instructions may execute entirely on the user's computer, partly on the user's computer, as a stand-alone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider). In some embodiments, electronic circuitry including, for example, programmable logic circuitry, field-programmable gate arrays (FPGA), or programmable logic arrays (PLA) may execute the computer readable program instructions by utilizing state information of the computer readable program instructions to personalize the electronic circuitry, in order to perform aspects of the present invention.

Aspects of the present invention are described herein with reference to flowchart illustrations and/or block diagrams of methods, apparatus (systems), and computer program products according to embodiments of the invention. It will be understood that each block of the flowchart illustrations and/or block diagrams, and combinations of blocks in the flowchart illustrations and/or block diagrams, can be implemented by computer readable program instructions.

These computer readable program instructions may be provided to a processor of a general purpose computer, special purpose computer, or other programmable data processing apparatus to produce a machine, such that the instructions, which execute via the processor of the computer or other programmable data processing apparatus, create means for implementing the functions/acts specified in the flowchart and/or block diagram block or blocks. These computer readable program instructions may also be stored in a computer readable storage medium that can direct a computer, a programmable data processing apparatus, and/or other devices to function in a particular manner, such that the computer readable storage medium having instructions stored therein comprises an article of manufacture including instructions which implement aspects of the function/act specified in the flowchart and/or block diagram block or blocks.

The computer readable program instructions may also be loaded onto a computer, other programmable data processing apparatus, or other device to cause a series of operational steps to be performed on the computer, other programmable apparatus or other device to produce a computer implemented process, such that the instructions which execute on the computer, other programmable apparatus, or other device implement the functions/acts specified in the flowchart and/or block diagram block or blocks.

The flowchart and block diagrams in the Figures illustrate the architecture, functionality, and operation of possible implementations of systems, methods, and computer program products according to various embodiments of the present invention. In this regard, each block in the flowchart or block diagrams may represent a module, segment, or portion of instructions, which comprises one or more executable instructions for implementing the specified logical function(s). In some alternative implementations, the functions noted in the block may occur out of the order noted in the figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts or carry out combinations of special purpose hardware and computer instructions.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising", when used in this specification, specify the presence of stated features, integers, steps, operations, elements, and/or components, but do not preclude the presence or addition of one or more other features, integers, steps, operations, elements, components and/or groups thereof.

The corresponding structures, materials, acts, and equivalents of all means or step plus function elements in the claims below, if any, are intended to include any structure, material, or act for performing the function in combination with other claimed elements as specifically claimed. The description of one or more aspects of the present invention has been presented for purposes of illustration and description, but is not intended to be exhaustive or limited to the invention in the form disclosed.

Many modifications and variations will be apparent to those of ordinary skill in the art without departing from the scope and spirit of the described embodiments. The terminology used herein was chosen to best explain the principles of the embodiments, the practical application or technical improvement over technologies found in the marketplace, or to enable others of ordinary skill in the art to understand the embodiments disclosed herein.

What is claimed is:

1. A computer-implemented method for detecting a music segment in an audio signal, the method comprising:

setting a time window for each section in the audio signal;

calculating a maximum and a statistic of the audio signal within the time window;

computing a density index for the section using the maximum and the statistic, the density index being a measure of the statistic relative to the maximum;

estimating the section as the music segment based, at least in part, on a condition with respect to the density index by comparing the density index with a first threshold and by comparing the maximum of the audio signal with a second threshold; and labeling each section of the audio signal to obtain a sequence of labeled sections.

2. The method of claim 1, wherein the statistic is a mean of the audio signal, and the density index is computed by dividing the mean by the maximum; and wherein each section determined to have the density index that is larger than the first threshold is estimated to be the music segment.

3. The method of claim 2, wherein the first threshold is set according to a standard deviation of density indices calculated from an audio data including a music part and a speech part.

4. The method of claim 1, wherein each section determined to have the maximum that is larger than the second threshold is estimated to be a non-music segment even if the condition with respect to the density index is satisfied.

5. The method of claim 4, wherein estimating the section further comprises:

comparing the maximum of the audio signal with a third threshold, wherein each section determined to have the maximum that is smaller than the third threshold is estimated to be the non-music segment even if the condition with respect to the density index is satisfied.

6. The method of claim 1, further comprising:

changing each one or more non-music segments sandwiched between music segments into a music segment if the one or more non-music segments have a length shorter than a fourth threshold.

7. The method of claim 6, further comprising:

changing each one or more music segments sandwiched between non-music segments into a non-music segment if the one or more music segments have a length shorter than a fifth threshold.

8. The method of claim 1, wherein the audio signal is represented by an absolute value of a signal of an audio waveform, energy of the signal of the audio waveform or a logarithm of energy of the signal of the audio waveform.

9. A computer system for detecting a music segment in an audio signal, by executing program instructions, the computer system comprising:

a memory storing the program instructions;

a processing circuitry in communications with the memory for executing the program instructions, wherein the processing circuitry is configured to:

set a time window for each section in the audio signal;

calculate a maximum and a statistic of the audio signal within the time window;

compute a density index for the section using the maximum and the statistic, wherein the density index is a measure of the statistic relative to the maximum;

estimate the section as the music segment based, at least in part, on a condition with respect to the density index by comparing the density index with a first threshold and by comparing the maximum of the audio signal with a second threshold; and label each section of the audio signal to obtain a sequence of labeled sections.

10. The computer system of claim 9, wherein the statistic is a mean of the audio signal, and the density index is computed by dividing the mean by the maximum; and wherein each section determined to have the density index that is larger than the first threshold is estimated to be the music segment.

11. The computer system of claim 9, wherein each section determined to have the maximum that is larger than the second threshold is estimated to be a non-music segment even if the condition with respect to the density index is satisfied.

12. The computer system of claim 11, wherein the processing circuitry is further configured to:

compare the maximum of the audio signal with a third threshold, wherein each section determined to have the maximum that is smaller than the third threshold is estimated to be the non-music segment even if the condition with respect to the density index is satisfied.

13. The computer system of claim 9, wherein the processing circuitry is further configured to:

change non-music segments sandwiched between music segments into music segments if the non-music segments have a length shorter than a fourth threshold.

14. The computer system of claim 13, wherein the processing circuitry is further configured to:

change the music segments sandwiched between non-music segments into non-music segments if the music segments have a length shorter than a fifth threshold.

15. A computer program product for detecting a music segment in an audio signal, the computer program product comprising a computer readable storage medium having program instructions embodied therewith, the program instructions executable by a computer to cause the computer to perform a method comprising:

setting a time window for each section in the audio signal;

calculating a maximum and a statistic of the audio signal within the time window;

computing a density index for the section using the maximum and the statistic, the density index being a measure of the statistic relative to the maximum;

estimating the section as the music segment based, at least in part, on a condition with respect to the density index by comparing the density index with a first threshold and by comparing the maximum of the audio signal with a second threshold; and labeling each section of the audio signal to obtain a sequence of labeled sections.

16. The computer program product of claim 15, wherein the statistic is a mean of the audio signal, and the density index is computed by dividing the mean by the maximum; and wherein each section determined to have the density index that is larger than the first threshold is estimated to be the music segment.

17. The computer program product of claim 15, wherein each section determined to have the maximum that is larger than the second threshold is estimated to be a non-music segment even if the condition with respect to the density index is satisfied.

18. The computer program product of claim 17, wherein estimating the section further comprises:

comparing the maximum of the audio signal with a third threshold, wherein each section determined to have the maximum that is smaller than the third threshold is estimated to be the non-music segment even if the condition with respect to the density index is satisfied.

19. The computer program product of claim 15, further comprising:

changing non-music segments sandwiched between music segments into the music segments if the non-music segments have a length shorter than a fourth threshold.

20. The computer program product of claim 19, wherein the method further comprises:

changing music segments sandwiched between non-music segments into the non-music segments if the music segments have a length shorter than a fifth threshold.

* * * * *